US006571521B1

(12) United States Patent
Ameigh

(10) Patent No.: US 6,571,521 B1
(45) Date of Patent: Jun. 3, 2003

(54) WALL SYSTEM AND COMPONENTS THEREOF

(76) Inventor: Archie Ameigh, 1501 W. Castlewood, Friendswood, TX (US) 77546

( * ) Notice: Subject to any disclaimer, the term of this patent is extended or adjusted under 35 U.S.C. 154(b) by 0 days.

(21) Appl. No.: 09/986,816

(22) Filed: Nov. 13, 2001

(51) Int. Cl.[7] ..... E02D 27/32; E02D 27/42; E04C 2/04; E04B 2/00

(52) U.S. Cl. ..... 52/295; 52/299; 52/600; 52/604; 52/606; 52/763; 52/745.09; 256/1; 256/19

(58) Field of Search ..... 52/295, 297, 299, 52/600, 606, 763, 780, 604, 779, 474, 742.12, 742.14, 742.15, 745.09, 300; 256/13.1, 1, 19; 33/1 R, 7, 304, 403, 404, 408, 409, 410, 418, 438, 518, 501.06, 196, 197, 199 B, 643, 644

(56) References Cited

U.S. PATENT DOCUMENTS 3,156,982 A * 11/1964 Wahlin ..... 33/408
5,095,633 A * 3/1992 Barnett ..... 33/518
5,125,162 A * 6/1992 Prebeck ..... 33/408
6,036,133 A * 3/2000 Milligan ..... 242/378.4
6,430,826 B1 * 8/2002 Sigl ..... 33/408

* cited by examiner

*Primary Examiner*—Jeanette Chapman
(74) *Attorney, Agent, or Firm*—Merek, Blackmon & Voorhees, LLC

(57) ABSTRACT

A wall system including at least a first brick fence segment. The first brick fence segment is formed from a plurality of bricks adhered together by mortar. The wall system further includes at least a first block column connected to the first brick fence segment. The first block column includes a plurality of blocks at least one of which is a column block. The column block has a front face, a rear face, a first end, a second end, a top and a bottom. A first recess is formed in the first end of the column block. The first recess is sized slightly larger than a width of a first brick of the first brick fence segment such that the first recess receives the first brick of the first brick fence segment. The first recess is formed by at least two opposing walls. A groove is formed in each of the two opposing walls to receive a leveling device. An isolation member formed from an elastomeric material is disposed in the first recess.

20 Claims, 6 Drawing Sheets

WALL SYSTEM AND COMPONENTS THEREOF

FIELD OF THE INVENTION

The present invention is directed to a wall system that can be used in numerous different locations as, for example, a fencing structure, a privacy structure and/or a sound barrier structure. More particularly, the present invention is directed to a wall structure utilizing fence brick and post blocks that can be readily constructed by relatively unskilled labors in a far more expeditious and inexpensive manner than prior known walls systems.

BACKGROUND OF THE INVENTION

Wall systems have commonly utilized brick to form both the fence segments and the post or column segments of the wall system. Brick is utilized because of its durability and aesthetically pleasing appearance. These types of wall systems are used, for example, as privacy structure, fencing structure and/or sound barrier structures. Prior known wall systems utilizing brick for both the fence and column/post segments have a number of inherent disadvantages. First, it takes approximately three hundred and twelve bricks to make one eight-foot column or post. Further, there are ten plumb points for a column made from brick. Accordingly, brick columns or posts are considerably more time consuming and costly to construct. Moreover, because of the large number of plumb points, among other things, brick columns or posts require a more skilled laborer to construct.

The present invention overcomes the disadvantages attendant prior wall systems by using specially designed blocks to form the column or post segments of the wall system. The column or posts are formed using a base block, a plurality of column blocks and a column or post cap. The column blocks are specially designed to interlock with the bricks forming the fence segments of the wall system. By using block as opposed to brick, an eight-foot column or post can be constructed using only 12 blocks as opposed to the three hundred and twelve bricks necessary to construct a post or column of a similar height made from brick. Further, there are only two plumb points for a block column as opposed 10 plumb points for a column made from brick. Moreover, the blocks of the present invention are specially designed to receive a leveling device. This feature allows the brick fence segments to be readily assembled in a level fashion.

OJECTS AND SUMMARY OF THE INVENTION

An object of the present invention is to provide a novel and unobvious wall system.

Another object of the present invention is to provide a wall system that overcomes one or more disadvantages of previously known wall systems.

An object of one embodiment of the present invention is to provide a wall system with a column block designed to interconnect at each end with bricks but not blocks.

Another object of one embodiment of the present invention is to provide a wall system with a column block that can readily accommodate a leveling device to allow a brick fence segment to be readily assembled in a level fashion.

A further object of one embodiment of the present invention is to provide a wall system that can be constructed by relatively unskilled laborers.

Yet another object of one embodiment of the present invention is to provide a wall system that can be constructed in a far more expeditious and inexpensive manner than prior known wall systems.

It must be understood that no one embodiment of the present invention need include all of the aforementioned objects of the present invention. Rather, a given embodiment may include one or more of the aforementioned objects. Accordingly, these objects are not to be used to limit the scope of the claims of the present invention.

In summary, one embodiment of the present invention is directed to a block for use in constructing a wall system having at least one brick fence segment and at least one block column. The block includes a front face, a rear face, a first end, a second end, a top and a bottom. An opening extends through the center of the block. The opening receives reinforcing structure such as rebar and is filled with grout. A first recess is formed in the first end of the block. The first recess is sized slightly larger than a width of a brick such that the first recess will receive a brick but not a block. A second recess is formed in the second end of the block. The second recess is sized slightly larger than a width of a brick such that the second recess will receive a brick but not a block. Another embodiment of the present invention is directed to a wall including at least a first brick fence segment. The first brick fence segment is formed from a plurality of bricks adhered together by mortar. The wall system further includes at least a first block column connected to the first brick fence segment. The first block column has a plurality of blocks at least one of which is a column block. The column block has a front face, a rear face, a first end, a second end, a top and a bottom. A first recess is formed in the first end of the at least one of the plurality of blocks. The first recess is sized slightly larger than a width of a first brick of the first brick fence segment such that the first recess receives the first brick of the first brick fence segment. A further embodiment of the present invention is directed to a block column for a wall system. The block column includes at least two column blocks stacked one on top of the other. Each of the column blocks has a front face, a rear face, a first end, a second end, a top and a bottom. A grout cavity is formed in each of the column blocks. A first recess is formed in the first end of each of the column blocks. The first recess is sized slightly larger than a width of a brick such that the first recess receives a brick but not a block. A second recess is formed in the second end of each of the column blocks. The second recess is sized slightly larger than a width of a brick such that the second recess will receive a brick but not a block.

DETAILED DESCRIPTION OF THE PREFERRED EMBODIMENT

The preferred forms of the invention will now be described with reference to FIGS. 1 through 8. The appended claims are not limited to the preferred embodiments and no term used herein is to be given a meaning other than its ordinary meaning unless accompanied by a statement that the term "as used herein is defined as follows."

FIGS. 1 Through 8

Figure 1:
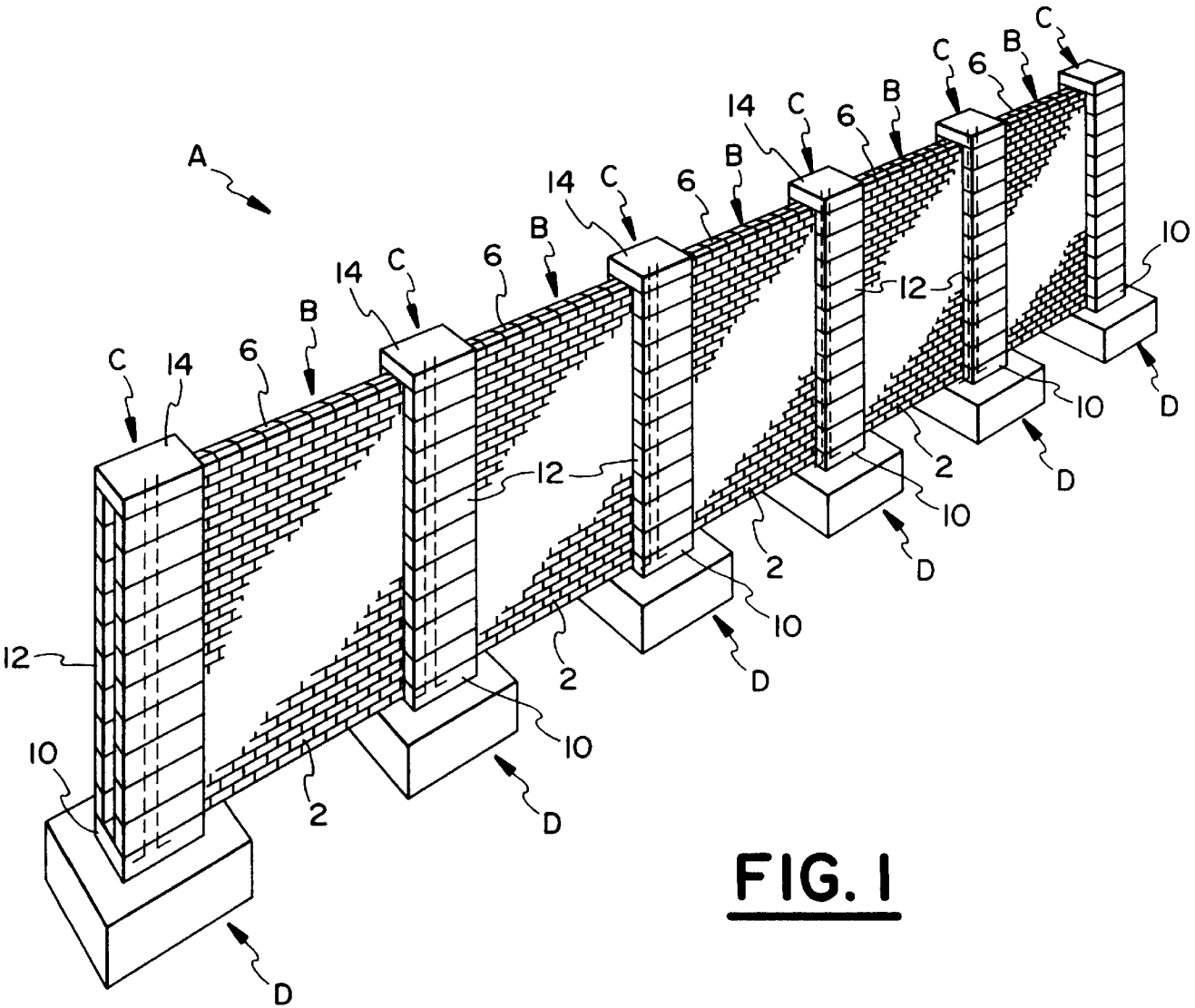
FIG. 1 is a perspective view of a wall system formed in accordance with a preferred embodiment of the present invention.
Figure 1A:
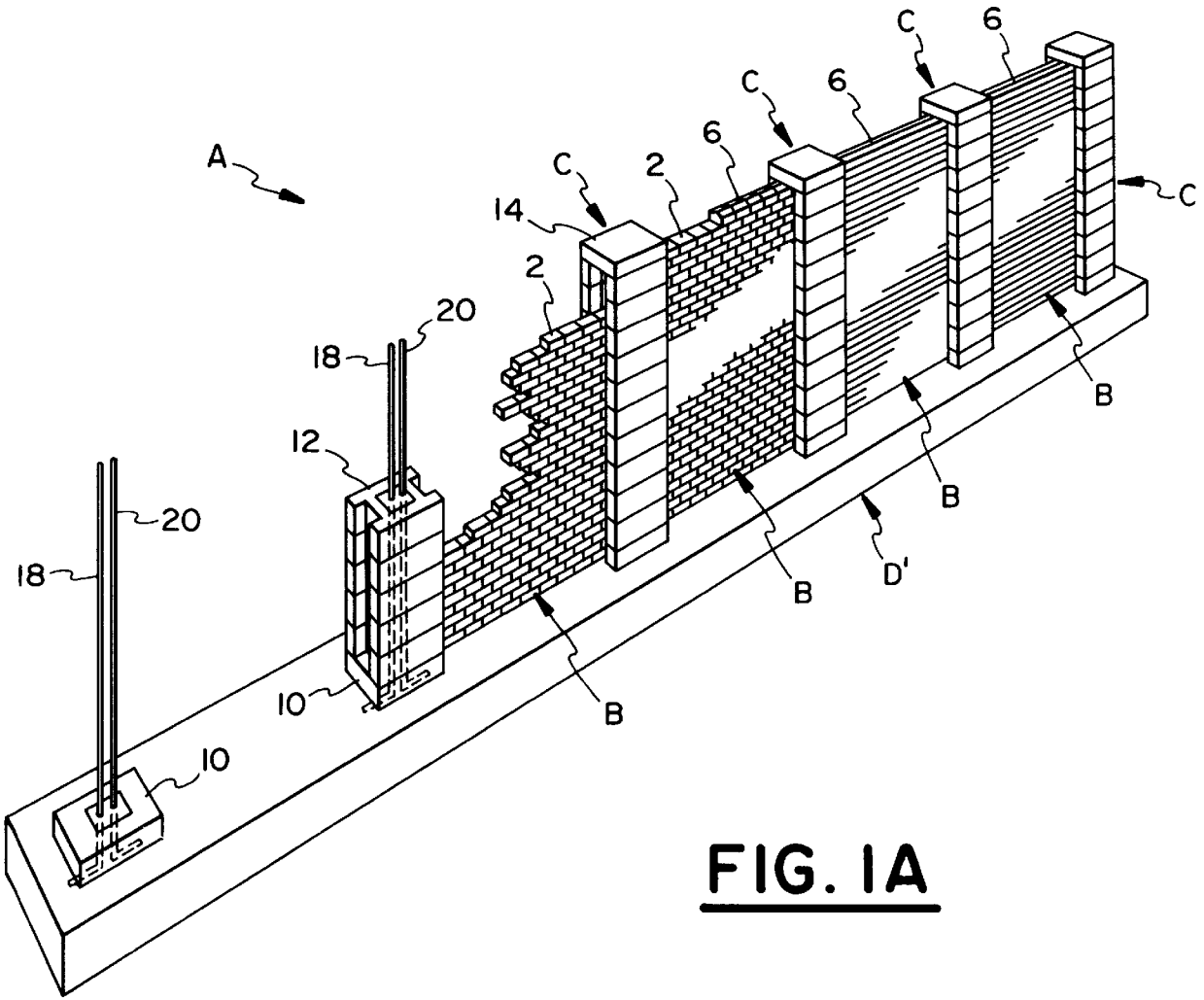
FIG. 1A is a perspective view of a system partially constructed in accordance with a preferred embodiment of the present invention.
Figure 5:
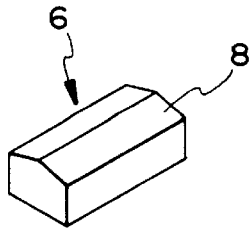
FIG. 5 is a perspective view of a fence cap of a wall system formed in accordance with a preferred embodiment of the present invention.
Figure 6:
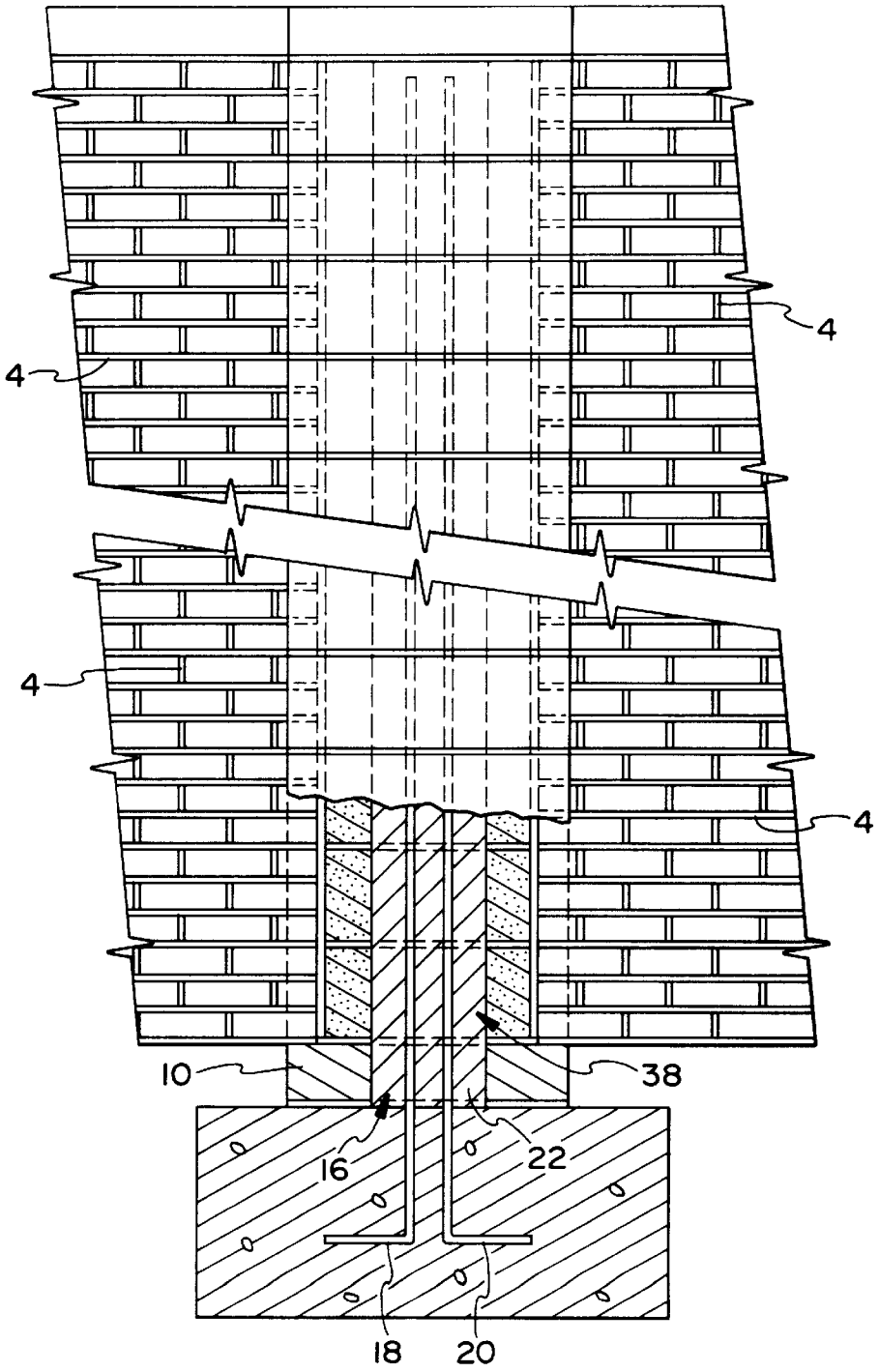
FIG. 6 is a front elevation view of a section of a wall system formed in accordance with a preferred embodiment of the present invention with a portion thereof broken away for illustration purposes.
Figure 8:
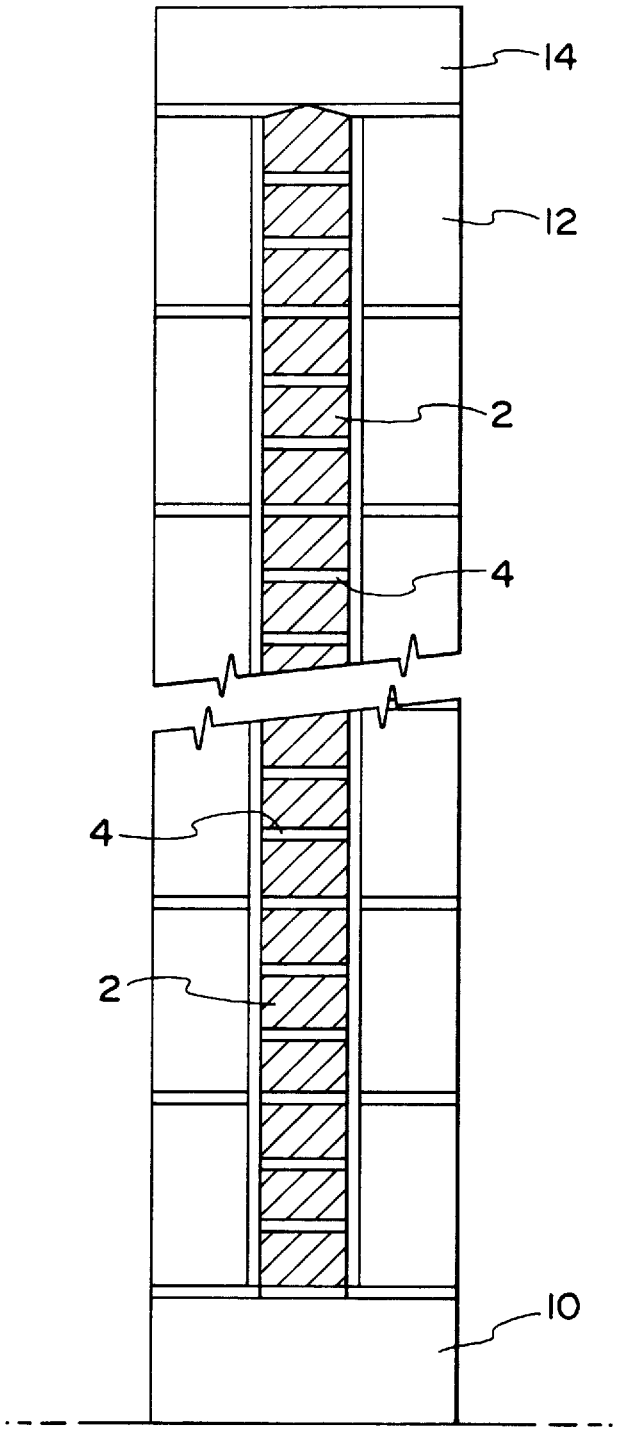
FIG. 8 is a cross-sectional view of a section taken through a fence segment of a wall system formed in accordance with a preferred embodiment of the present invention.

Referring to FIGS. 1 and 8, a wall system A is depicted. The wall system A includes a plurality of brick fence segments B and block columns or posts C. The wall system further includes footers D at each of the block columns or posts C. Alternatively, a footer D' may be used, as shown in FIG. 1A. Referring to FIGS. 1 and 6, the brick fence segment B includes a plurality of conventionally sized bricks 2 which are adhered together via mortar 4. The brick fence segments B may also include a plurality of fence caps 6 as shown in FIGS. 1, 1A and 5. The fence caps 6 preferably have a triangular shaped top surface 8 to facilitate drainage. It will be readily appreciated by those skilled in the art that the fence caps 6 may be configured in numerous other manners to facilitate drainage.

Referring to FIGS. 1 and 2 through 4, the block columns or posts C include a base block 10, a plurality of column blocks 12 and a column cap 14. The number of column blocks in any given block column C will depend directly on the desired height of the column. The base block 10 is optional. Preferably, when used it is placed on the footing D and supports the column blocks 12 and column cap 14. Preferably, the base block 10 is rectangular in shape and is 5" in height by 13" in width or depth by 24" in length. It will be readily appreciated by those of ordinary skill in the art that these dimensions of the base block 10 may be varied as desired. The base block 10 has a grout cavity 16 disposed in the center thereof. Referring to FIGS. 6 and 8, the grout cavity 16 receives rebar 18 and 20 as well as grout 22. It will be readily appreciated that other suitable reinforcing structure may be used in place of or in addition to the rebar 18 and 20.

Figure 2:
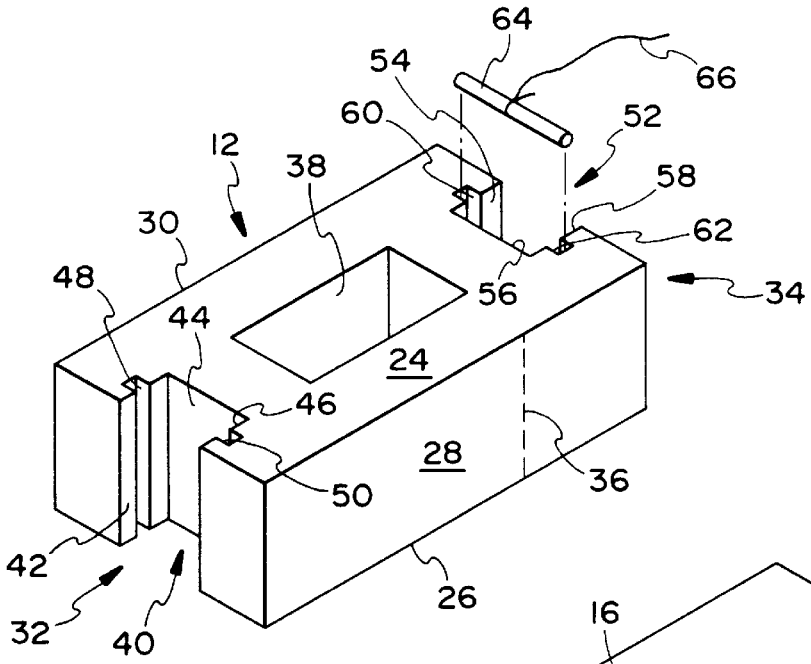
FIG. 2 is a perspective view of a column block of a wall system formed in accordance with a preferred embodiment of the present invention.
Figure 3:
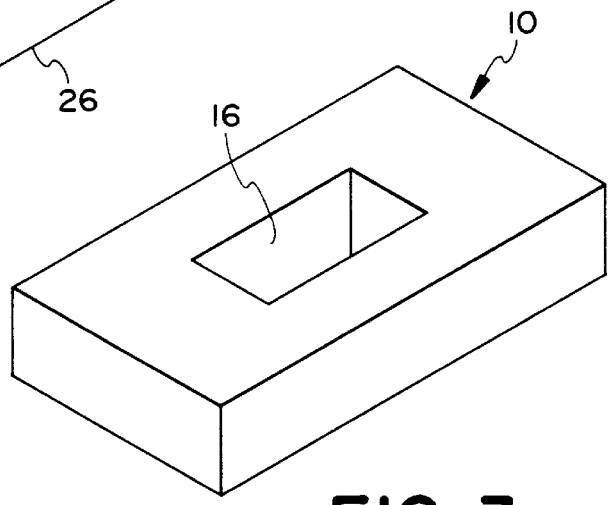
FIG. 3 is a perspective view of a base block of a wall system formed in accordance with a preferred embodiment of the present invention.

Referring to FIG. 2, the column blocks 12 include a top 24, a bottom 26, a front face 28, a rear face 30, a left end 32 and a right end 34. The top 24 and bottom 26 are substantially planar. Further, these surfaces are free from projections or recesses such as disclosed in U.S. Pat. No. 5,623,797 that interlock one block with another. The front face 28 and/or the rear face 30 may be scored as illustrated at 36 to enable the length of the column block 12 to be readily varied as desired. A grout cavity 38 is formed in the center of column block 12. Referring to FIG. 6, the grout cavity 38 is aligned with grout cavity 16 of the base block 10 and receives rebar 18 and 20 as well as grout 22.

A recess 40 is formed in the left end 32 of column block 12. Walls 42, 44 and 46 define the recess 40. Preferably, opposing walls 42 and 46 are spaced 5" apart such that a brick but not a block may be received in the recess 40. A groove 48 is formed in wall 42. Preferably, groove 48 extends from the uppermost portion to the lowermost portion of wall 42. A groove 50 is formed in wall 46. Preferably, groove 50 extends from the uppermost portion to the lowermost portion of wall 46. Groove 48 is aligned with groove 50 so that a bar with a leveling line attached thereto can be readily inserted into and held in place by the grooves. In this fashion, the brick fence segments can be readily constructed in a level fashion.

A recess 52 is formed in the left end 34 of column block 12. Walls 54, 56 and 58 define the recess 52. Preferably, opposing walls 54 and 58 are spaced 5" apart such that a brick but not a block may be received in the recess 52. A groove 60 is formed in wall 54. Preferably, groove 60 extends from the uppermost portion to the lowermost portion of wall 54. A groove 62 is formed in wall 58. Preferably, groove 62 extends from the uppermost portion to the lowermost portion of wall 58. Groove 60 is aligned with groove 62 so that bar 64 with a leveling line 66 attached thereto can be readily inserted into and held in place by the grooves. In this fashion, the corresponding brick fence segment can be readily constructed in a level fashion.

Figure 7:
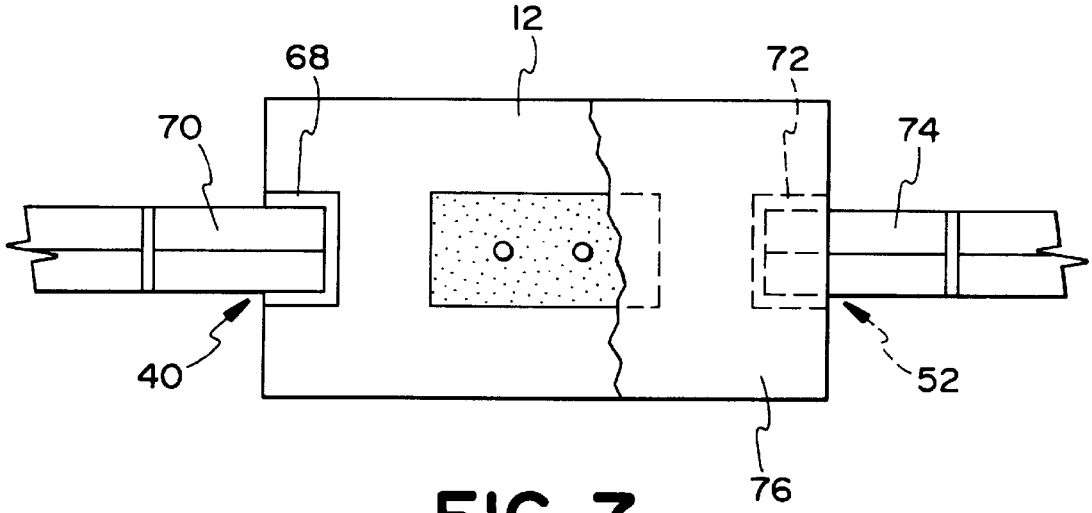
FIG. 7 is a plan view of a section of a wall system formed in accordance with a preferred embodiment of the present invention with a portion thereof broken away for illustration purposes.

Referring to FIG. 7, an isolation member 68 is disposed between the walls forming recess 40 and the corresponding brick 70. The isolation member 68 is formed from an elastomeric material, preferably foam rubber. One suitable material is Sonoflex F from Sonneborn. It will be readily appreciated that any other suitable material may be used. The isolation member 68 isolates the column block 12 from the corresponding brick 70 to prevent damage to these individual components of the wall system and to ensure a more sturdy wall structure. An isolation member 72 is disposed between the walls forming recess 52 and the corresponding brick 74. The isolation member 72 is formed from an elastomeric material and functions in a manner similar to isolation member 68.

Preferably, the column block is rectangular in shape and is 8" in height by 13" in width or depth by 24" in length. It will be readily appreciated by those of ordinary skill in the art that these dimensions of the column block 12 may be varied as desired.

It will be readily appreciated by those of ordinary skill in the art that the column block 12 may be formed in an angled fashion, for example, a right angle where the column block is to be used as a corner block.

Figure 4:
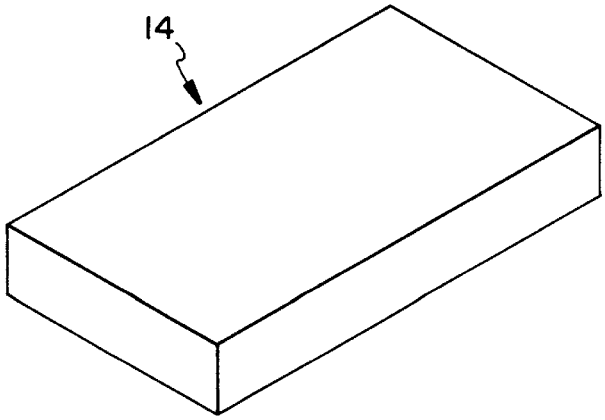
FIG. 4 is a perspective view of a column cap of a wall system formed in accordance with a preferred embodiment of the present invention.

Referring to FIG. 4, column cap 76 is preferably rectangular in shape and is 4" in height by 13" in width or depth by 24" in length. As seen in FIGS. 1 and 7, column cap 76 forms the uppermost portion of the column or post C. The column cap is free of any openings.

While this invention has been described as having a preferred design, it is understood that it is capable of further modifications, uses and/or adaptations of the invention following in general the principle of the invention and including such departures from the present invention as come within the known or customary practice in the art to which the invention pertains and as may be applied to the central features hereinbefore set forth, and fall within the scope of the invention and the limits of the appended claims.

I claim:

1. A wall system, comprising:

(a) at least a first brick fence segment, said first brick fence segment being formed from a plurality of bricks adhered together by mortar;

(b) at least a first block column connected to said first brick fence segment, said first block column having a plurality of blocks at least one of which is a column block;

(c) said column block having a front face, a rear face, a first end, a second end, a top and a bottom, a first recess is formed in said first end of said at least one of said plurality of blocks, said first recess being sized slightly larger than a width of a first brick of said first brick fence segment such that said first recess receives said first brick of said first brick fence segment.

2. A wall system as set forth in claim 1, further including:

(a) a second brick fence segment connected to said first block column said second brick fence segment being formed from a plurality of bricks adhered together by mortar; and, (b) said second end of said at least one of said plurality of blocks having a second recess formed therein, said second recess being sized slightly larger than a width of a second brick from said second brick fence segment such that said second recess receives said second brick.

3. A wall system as set forth in claim 2, wherein:

(a) said first recess is formed by at least first and second opposing walls, at least one of said first and second opposing walls has a groove formed therein for receiving a leveling device.

4. A wall system as set forth in claim 1, wherein:

(a) an isolation member is positioned in said first recess.

5. A wall system as set forth in claim 3, wherein:

(a) said isolation member is formed from an elastomeric material.

6. A wall system as set forth in claim 1, wherein:

(a) said top of said at least one of said plurality of blocks is substantially planar and free from any upwardly projecting members.

7. A wall system as set forth in claim 2, wherein:

(a) an isolation member is positioned in said second recess.

8. A wall system as set forth in claim 7, wherein:

(a) said isolation member is formed from an elastomeric material.

9. A wall system as set forth in claim 1, wherein:

(a) said plurality of blocks include at least two column blocks, a base block and a column cap; and, (b) said at least two column blocks having a grout cavity formed therein, said base block having a grout cavity, said column cap being free of grout cavities.

10. A block column for a wall system, said block column comprising:

(a) at least two column blocks stacked one on top of the other, each of said column blocks having a front face, a rear face, a first end, a second end, a top and a bottom;

(b) a grout cavity formed in each of said column blocks;

(c) a first recess formed in said first end of each of said column blocks, said first recess being sized slightly larger than a width of a brick such that said first recess will receive a brick but not a block;

(d) a second recess formed in said second end of each of said column blocks; and, (e) an isolation member being disposed in said first recess of each of said column blocks, said isolation member being formed from an elastomeric material.

11. A block column as set forth in claim 10, wherein:

(a) said second recess being sized slightly larger than a width of a brick such that said second recess will receive a brick but not a block, an isolation member is disposed in said second recess of each of said column blocks, said isolation member being formed from an elastomeric material.

12. A block column as set forth in claim 10, wherein:

(a) said top and bottom of each of said column blocks is planar and free from projections.

13. A block column as set forth in claim 10, wherein:

(a) said first recess of each of said column blocks is formed by at least first and second opposing walls, at least one of said first and second opposing walls have a groove formed therein for receiving a leveling device;

(b) said second recess of each of said column blocks is formed by at least third and fourth opposing walls, at least one of said third and fourth opposing walls have a groove formed therein for receiving a leveling device.

14. An apparatus for use in constructing at least one fence segment of a wall system, said apparatus comprising:

(a) at least one block having a front face, a rear face, a first end, a second end, a top and a bottom;

(b) a first recess being formed in said first end of said block, said first recess being sized to receive a portion of a fence segment;

(c) said first recess is formed by at least first and second opposing side walls, at least one of said first and second opposing side walls having a groove formed therein; and, (d) a leveling device positioned in said groove for leveling at least a portion of the fence segment.

15. An apparatus as set forth in claim 14, wherein:

(a) said first end of said block being open and thereby free of end walls that would act to close said first end.

16. An apparatus as set forth in claim 14, wherein;

(a) said leveling device includes a bar.

17. An apparatus as set forth in claim 16, wherein;

(a) a leveling line extends from said bar to aid in leveling a portion of the fence segment.

18. An apparatus as set forth in claim 16, wherein:

(a) said bar extends generally horizontally.

19. An apparatus as set forth in claim 16, wherein:

(a) said bar extends substantially perpendicular to said front face of said block.

20. An apparatus for use in constructing at least one fence segment of a wall system, said apparatus comprising:

(a) at least one block having a front face, a rear face, a first end, a second end, a top and a bottom;

(b) a first recess being formed in said first end of said block, said first recess being sized to receive a portion of a fence segment;

(c) said first recess is formed by at least first and second opposing side walls, at least one of said first and second opposing side walls having a groove formed therein; and, (d) means for leveling at least a portion of the fence segment, said means for leveling being operably associated with said groove.

* * * * *